US008590198B2

(12) United States Patent
Kasper

(10) Patent No.: US 8,590,198 B2
(45) Date of Patent: Nov. 26, 2013

(54) REVOLVER WITH CYLINDER SHROUD

(76) Inventor: James Edward Kasper, Tipton, IA (US)

( * ) Notice: Subject to any disclaimer, the term of this patent is extended or adjusted under 35 U.S.C. 154(b) by 202 days.

(21) Appl. No.: 13/315,974

(22) Filed: Dec. 9, 2011

(65) Prior Publication Data

US 2013/0145667 A1 Jun. 13, 2013

(51) Int. Cl.
*F41C 3/14* (2006.01)

(52) U.S. Cl.
USPC ..... 42/59; 42/66

(58) Field of Classification Search
USPC ..... 42/59, 65–67
See application file for complete search history.

(56) References Cited

U.S. PATENT DOCUMENTS 2,647,338 A * 8/1953 McNally ..... 42/66
3,163,951 A * 1/1965 Lewis ..... 42/65
3,221,433 A * 12/1965 Lewis ..... 42/62
3,280,495 A * 10/1966 Lewis ..... 42/59
3,303,594 A * 2/1967 Lewis ..... 42/59
3,526,052 A * 9/1970 Ferri ..... 42/57
4,466,537 A * 8/1984 McMahan ..... 206/317
6,266,908 B1 * 7/2001 Spencer et al. ..... 42/71.02
6,330,761 B1 * 12/2001 Duval et al. ..... 42/59
7,591,402 B2 * 9/2009 Rassias ..... 224/243

* cited by examiner

*Primary Examiner* — Michael David
(74) *Attorney, Agent, or Firm* — Bennet K. Langlotz; Langlotz Patent & Trademark Works, Inc.

(57) ABSTRACT

Revolvers with cylinder shrouds include first and second shroud portions, each having a cylindrical wall portion having a length at least as great as the length of a revolver cylinder and an interior surface shaped to be closely spaced apart from an exterior surface portion of the cylinder. The first and second shroud portions each include a fastening mechanism operable to removably connect the first shroud to a revolver frame. The first and second shroud portions each include a fastening element operable to removably connect the first and second shroud portions to the frame to cover the cylinder. The first and second shroud portions may have a major cylindrical wall portion having a radius of curvature centered on axis defined by the cylinder when the first and second shroud portions are connected to the frame.

18 Claims, 16 Drawing Sheets

REVOLVER WITH CYLINDER SHROUD

FIELD OF THE INVENTION

The present invention relates to a revolver with cylinder shroud that shields the cylinder from obstruction or stoppage.

BACKGROUND OF THE INVENTION

Revolvers are sometimes preferred for concealed carry applications because of their operational characteristics. Unlike semi-automatic pistols, which have a reciprocating slide that relies on delicately balanced spring pressure to chamber a fresh cartridge, revolvers have a rotating cylinder. This makes revolvers especially attractive for being carried in a pocket. Because a revolver rotates between shots, it is much less likely to get caught in clothing fabric than a semi-automatic pistol is.

However, there is still a chance that the cylinder could become bound up by fabric if the revolver is fired from a pocket. Revolvers are also vulnerable to becoming locked up if the cylinder is pushed or squished.

Revolvers have two main issues in reliability: the hammer being interfered with, and the cylinder being frozen. The former problem is known to have been addressed by partially or completely enclosing the hammer. However, the latter problem is not known to have been addressed in a serious manner.

Therefore, a need exists for a new and improved revolver with cylinder shroud that shields the cylinder from obstruction or stoppage. In this regard, the various embodiments of the present invention substantially fulfill at least some of these needs. In this respect, the revolver with cylinder shroud according to the present invention substantially departs from the conventional concepts and designs of the prior art, and in doing so provides an apparatus primarily developed for the purpose of shielding the cylinder from obstruction or stoppage, such as by clothing when shooting from a pocket or by being grabbed by an assailant.

SUMMARY OF THE INVENTION

The present invention provides an improved revolver with cylinder shroud, and overcomes the above-mentioned disadvantages and drawbacks of the prior art. As such, the general purpose of the present invention, which will be described subsequently in greater detail, is to provide an improved revolver with cylinder shroud that has all the advantages of the prior art.

To attain this, the preferred embodiment of the present invention essentially comprises first and second shroud portions, each having a cylindrical wall portion having a length at least as great as the length of a revolver cylinder and an interior surface shaped to be closely spaced apart from an exterior surface portion of the cylinder. The first and second shroud portions each include a fastening mechanism operable to removably connect the first shroud to a revolver frame. The first and second shroud portions each include a fastening element operable to removably connect the first and second shroud portions to the frame to cover the cylinder. The first and second shroud portions may have a major cylindrical wall portion having a radius of curvature centered on axis defined by the cylinder when the first and second shroud portions are connected to the frame. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
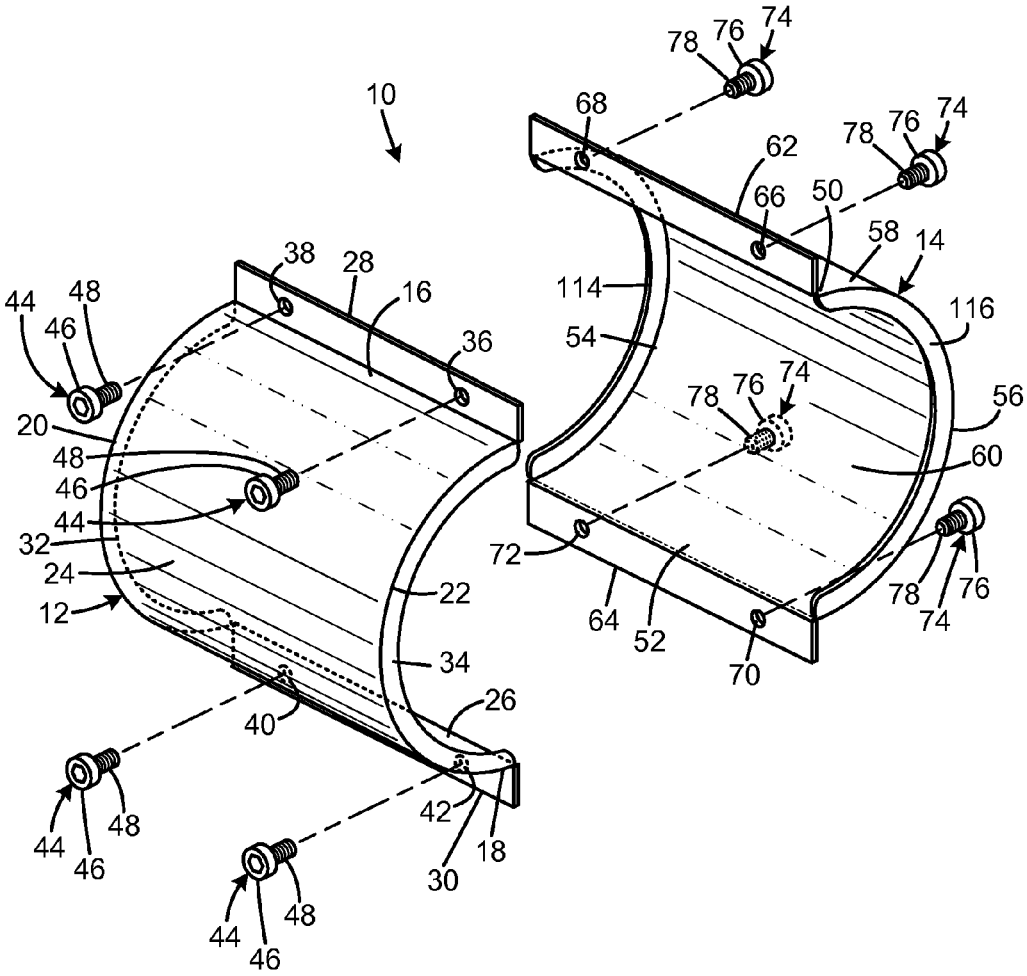
FIG. 1 is a rear isometric exploded view of the current embodiment of the cylinder shroud constructed in accordance with the principles of the present invention.

A preferred embodiment of the cylinder shroud of the present invention is shown and generally designated by the reference numeral 10.

FIG. 1 illustrates the improved cylinder shroud 10 of the present invention. More particularly, the cylinder shroud has a left shell 12 and a right shell 14. The shells are mirror images of one another in the current embodiment.

The left shell 12 is a semi-cylindrical body having a top 16, a bottom 18, a front 20, a rear 22, an exterior 24, and an interior 26. The front defines a front lip 32 that extends inwards. The rear defines a rear lip 34 that extends inwards. The lips are semicircular flanges with rounded concave edges that face one another. Each lip occupies a plane perpendicular to an axis defined by the semi-cylindrical body and depending toward the axis. The top of the left shell defines an upper flange 28. The upper flange extends perpendicularly upwards from the top of the left shell and defines two bolt holes 36, 38. The bottom of the left shell defines a lower flange 30. The lower flange extends perpendicularly downwards from the bottom of the left shell and defines two bolt holes 40, 42. The bolt holes 36, 38, 40, and 42 are sized to permit passage of the threaded portions 48 of bolts 44 and to obstruct passage of the head portions 46 of bolts 44.

The right shell 14 is a semi-cylindrical body having a top 50, a bottom 52, a front 54, a rear 56, an exterior 58, and an interior 60. The front defines a front lip 114 that extends inwards. The rear defines a rear lip 116 that extends inwards. The lips are semicircular flanges with rounded concave edges that face one another. Each lip occupies a plane perpendicular to an axis defined by the semi-cylindrical body and depending toward the axis. The top of the right shell defines an upper flange 62. The upper flange extends perpendicularly upwards from the top of the right shell and defines two bolt holes 66, 68. The bottom of the right shell defines a lower flange 64. The lower flange extends perpendicularly downwards from the bottom of the right shell and defines two bolt holes 70, 72. The bolt holes 66, 68, 70, and 72 are sized to permit passage of the threaded portions 78 of bolts 74 and to obstruct passage of the head portions 76 of bolts 74.

The curved front and rear lips at either end of the shells add strength to resist compression of the left and right shells against the cylinder. Also, when the lips are deep enough, they prevent easily stopping cylinder revolution via grabbing or jamming the ends of the cylinder.

Figure 2:
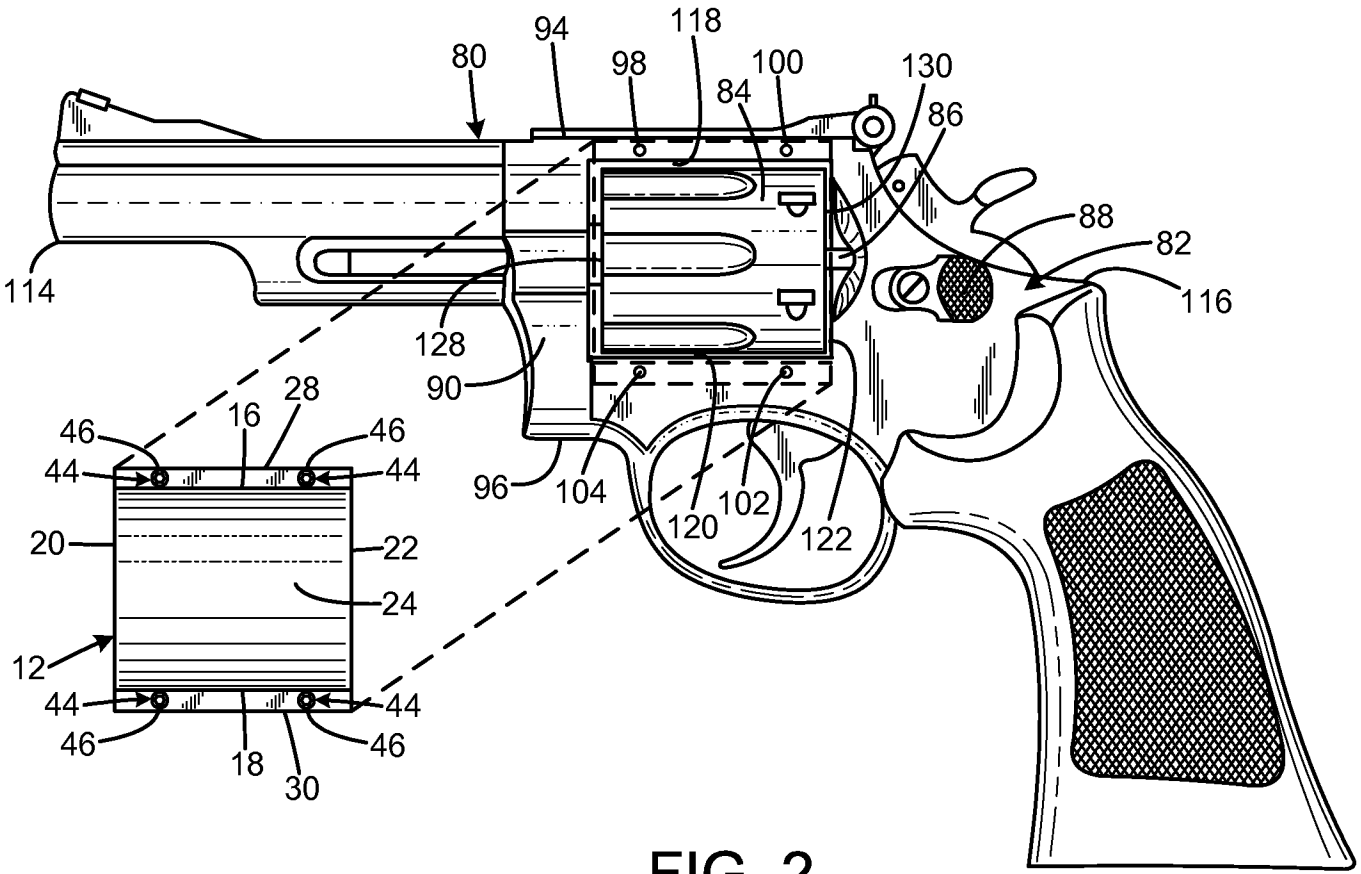
FIG. 2 is a left side exploded view of the current embodiment of the revolver with cylinder shroud with the left shell of FIG. 1 removed.

FIG. 2 illustrates the left shell 12 removed from a revolver 80 that is adapted to receive the left and right shells of FIG. 1. More particularly, the revolver has a frame 82 having a left side 90, a right side 92 (shown in FIG. 3), a top 94, a bottom 96, a front 114, and a rear 116. A cylinder 84 having a front 128 and a rear 130 is rotatably mounted on a center pin 86 within a cavity 122 defined by the frame. An upper gap 118 and a lower gap 120 are present between the cylinder and the frame when the cylinder is mounted in the cavity. A thumbpiece 88 protrudes from the rear 116 of the frame behind the cavity. The thumbpiece is operable to release the rearmost portion of the center pin from the cavity, which permits the cylinder to swing outwards from the frame to the left to enable reloading.

The left side 90 of the frame 82 of the revolver is drilled and tapped with threaded bores 98, 100, 102, and 104 above and below the cavity 122. The left shell 12 is removably attached to the frame such that the left shell covers the portion of the cylinder 84 that protrudes from the left side of the frame. This is accomplished by screwing bolts 44 into the threaded bores in the left side of the frame. The threaded bores are aligned with the bolt holes 38, 36, 40, and 42 in the left shell when the left shell is positioned so the front 128 and rear 130 of the cylinder are enclosed between the front lip 32 and rear lip 34. The bolts must be unscrewed and the left shell removed in order to permit the cylinder to swing outwards from the frame to the left to enable reloading.

Figure 3:
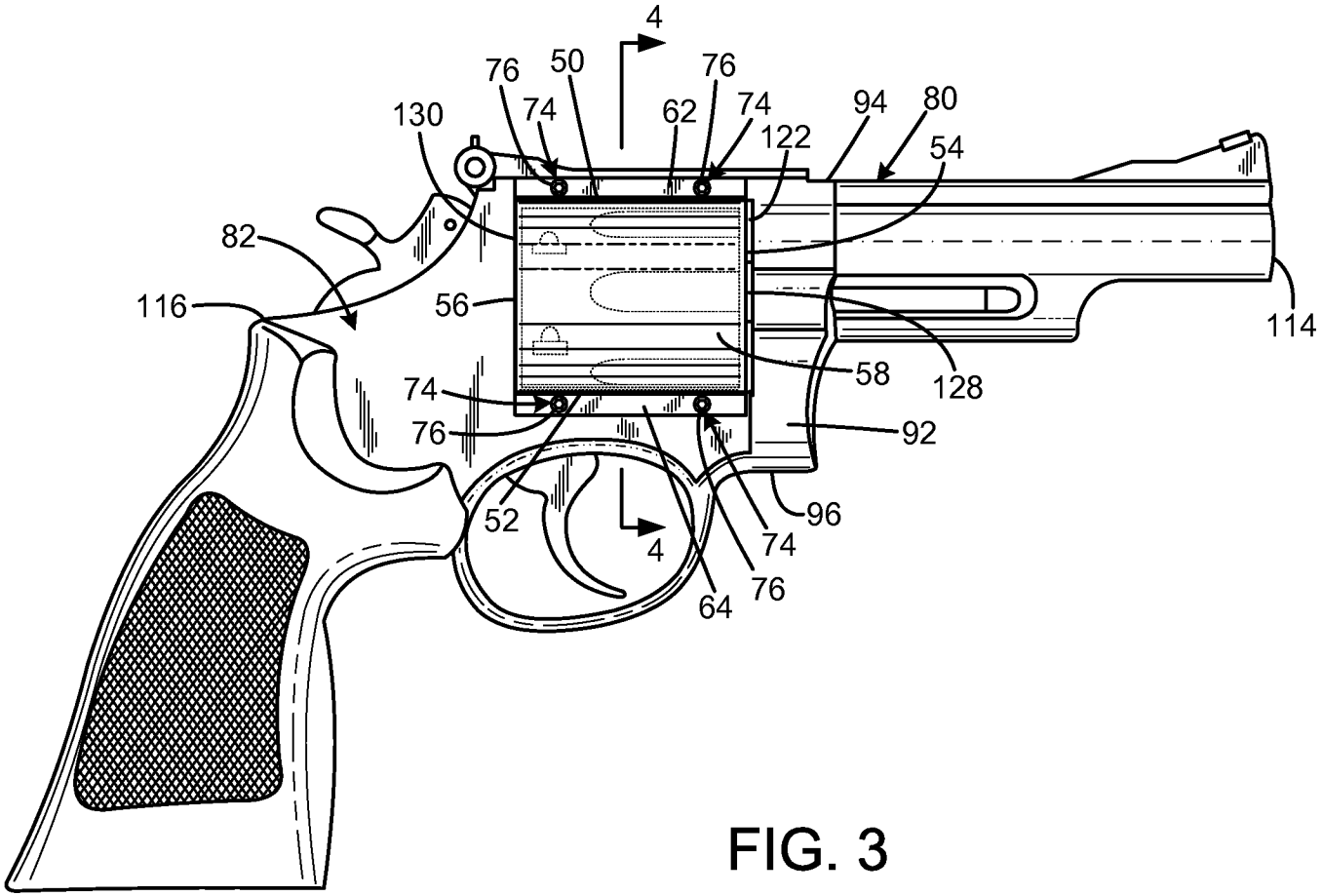
FIG. 3 is a right side view of the current embodiment of the revolver with cylinder shroud of FIG. 2 with the right shell of FIG. 1 installed.

FIG. 3 illustrates the right shell 14 installed on the revolver 80 of FIG. 2. More particularly, the right side 92 of the frame 82 of the revolver is drilled and tapped with threaded bores (not visible) above and below the cavity 122. The right shell 14 is removably attached to the frame such that the right shell covers the portion of the cylinder 84 that protrudes from the right side of the frame. This is accomplished by screwing bolts 74 into the threaded bores in the right side of the frame. The threaded bores are aligned with the bolt holes 68, 66, 72, and 70 in the right shell when the right shell is positioned so the front 128 and rear 130 of the cylinder are enclosed between the front lip 32 and rear lip 34. The right shell does not need to be removed in order to permit the cylinder to swing outwards from the frame to the left to enable reloading.

Figure 4:
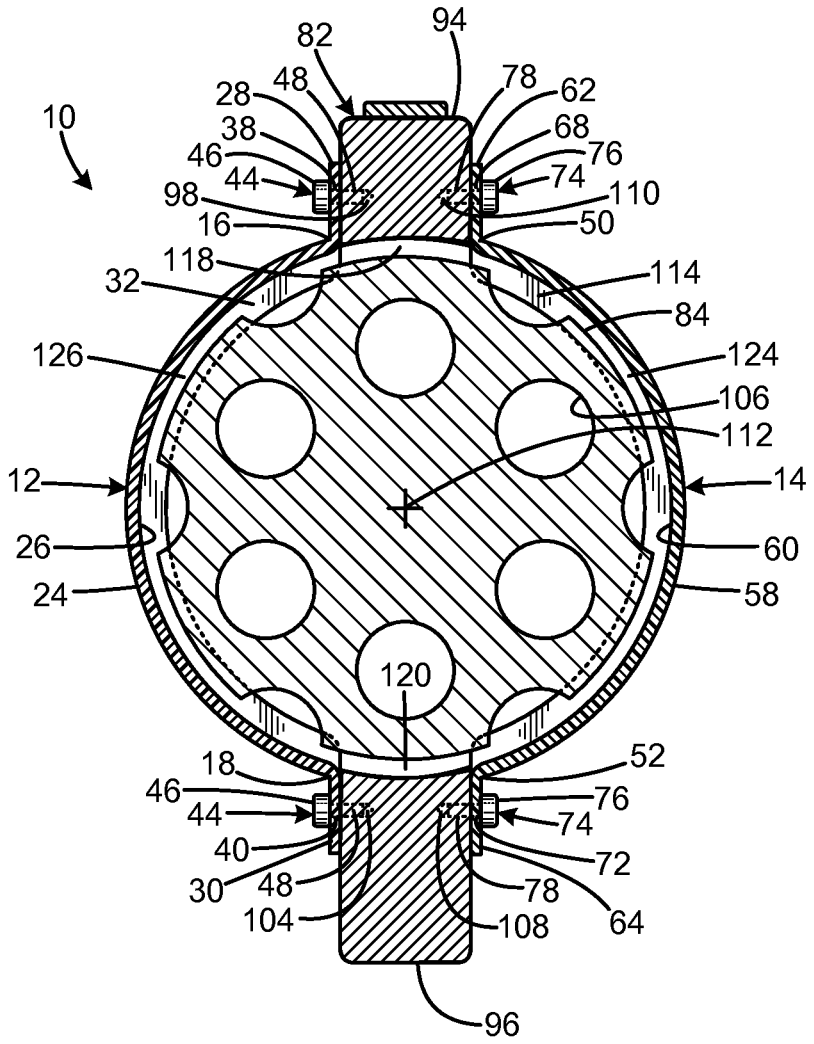
FIG. 4 is a cross-section view taken along the line 4-4 of FIG. 3.

FIG. 4 illustrates the improved cylinder shroud 10 of FIG. 1 installed on the revolver of FIGS. 2 and 3. More particularly, the cylinder 84 has six chambers 106 and defines a rotation axis 112. The semi-cylindrical bodies of the left shell 12 and right shell 14 have a radius of curvature centered on the rotation axis of the cylinder when the left and right shells are connected to the frame 82. The cylinder 84 is located within the cavity 122 such that an upper gap 118 exists between the cylinder and the top 94 of the frame and a lower gap 120 exists between the cylinder and the bottom 96 of the frame. Furthermore, a gap 124 exists between the interior 60 of the right shell and the cylinder and a gap 126 exists between the interior 26 of the left shell and the cylinder. These gaps 118, 120, 124, and 126 enable the cylinder to rotate without obstruction or stoppage by either the frame or the left and right shells.

The forwardmost bolts 44 that removably attach the upper flange 28 and lower flange 30 of the left shell 12 to the frame 82 are shown. To attach the front of the upper flange of the left shell, the threaded portion 48 of a bolt 44 passes through the bolt hole 38 and is threadedly received by the threaded bore 98 in the frame. To attach the front of the lower flange of the left shell, the threaded portion 48 of a bolt 44 passes through the bolt hole 40 and is threadedly received by the threaded bore 104 in the frame.

The forwardmost bolts 74 that removably attach the upper flange 62 and the lower flange 64 of the right shell 14 to the frame 82 are also shown. To attach the front of the upper flange of the right shell, the threaded portion 78 of the bolt 74 passes through the bolt hole 68 and is threadedly received by the threaded bore 110 in the frame. To attach the front of the lower flange of the right shell, the threaded portion 48 of the bolt 44 passes through the bolt hole 72 and is threadedly received by the threaded bore 108 in the frame.

Figure 5:
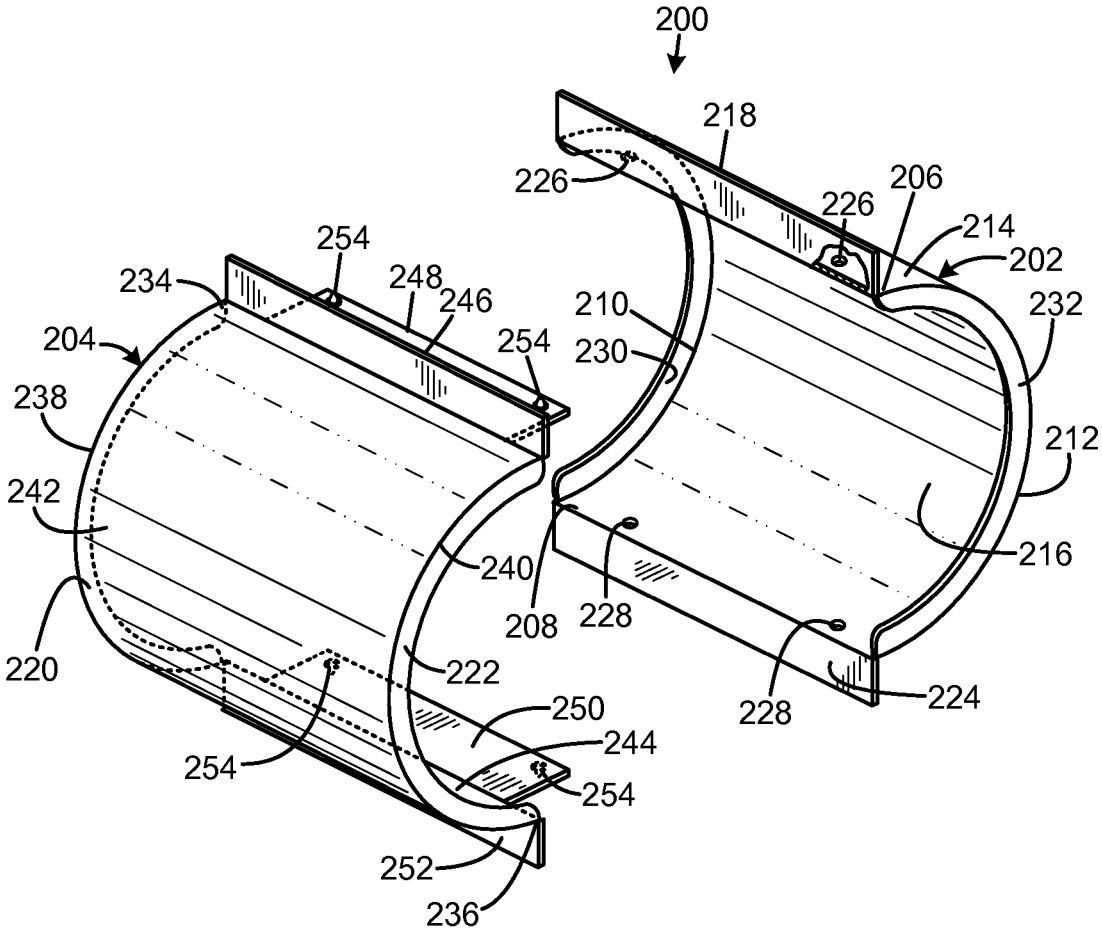
FIG. 5 is a rear isometric view of a first alternative embodiment of the cylinder shroud constructed in accordance with the principles of the present invention.

FIG. 5 illustrates a first alternative embodiment of the improved cylinder shroud 200 of the present invention. More particularly, the cylinder shroud has a left shell 204 and a right shell 202. The shells are substantially mirror images of one another in the current embodiment except for the horizontal flanges 248, 250 on the left shell and the holes 226, 228 on the right shell.

The left shell 204 is a semi-cylindrical body having a top 234, a bottom 236, a front 238, a rear 240, an exterior 242, and an interior 244. The front defines a front lip 220 that extends inwards. The rear defines a rear lip 222 that extends inwards. The lips are semicircular flanges with rounded concave edges that face one another. Each lip occupies a plane perpendicular to an axis defined by the semi-cylindrical body and depending toward the axis. The top of the left shell defines an upper flange 246. The upper flange extends perpendicularly upwards from the top of the left shell. An upper horizontal flange 248 extends inwards from the top of the left shell. The upper horizontal flange has two dimples 254 that extend upwards away from the interior of the left shell. The bottom of the left shell defines a lower flange 252. The lower flange extends perpendicularly downwards from the bottom of the left shell. A lower horizontal flange 250 extends inwards from the bottom of the left shell. The lower horizontal flange has two dimples 254 that extend downwards away from the interior of the left shell.

The right shell 202 is a semi-cylindrical body having a top 206, a bottom 208, a front 210, a rear 212, an exterior 214, and an interior 216. The front defines a front lip 230 that extends inwards. The rear defines a rear lip 232 that extends inwards. The lips are semicircular flanges with rounded concave edges that face one another. Each lip occupies a plane perpendicular to an axis defined by the semi-cylindrical body and depending toward the axis. The top of the right shell defines an upper flange 218. The upper flange extends perpendicularly upwards from the top of the right shell. The top of the right shell defines two dimple holes 226 positioned immediately behind the upper flange. The bottom of the right shell defines a lower flange 224. The lower flange extends perpendicularly downwards from the bottom of the right shell. The bottom of the right shell defines two dimple holes 228 positioned immediately behind the lower flange. The dimple holes 226, 228 are sized to readily permit entry of the dimples 254, and to resist but ultimately permit withdrawal of the dimples 254.

Figure 6:
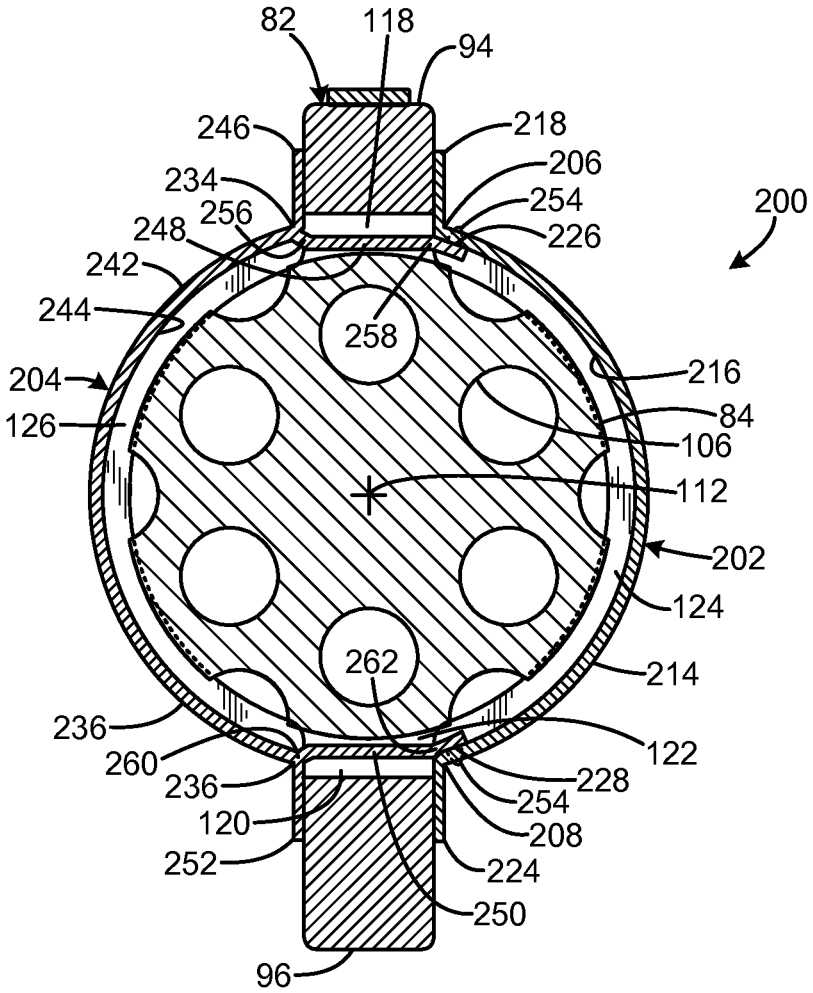
FIG. 6 is a cross-section view of a first alternative embodiment of the revolver with cylinder shroud with the cylinder shroud of FIG. 5 installed thereon.

FIG. 6 illustrates the improved cylinder shroud 200 of FIG. 5 installed on a revolver identical to the revolver depicted in FIGS. 2-4 except for the omission of the threaded bore holes in the frame. More particularly, the cylinder 84 has six chambers 106 and defines a rotation axis 112. The semi-cylindrical bodies of the left shell 204 and right shell 202 have a radius of curvature centered on the rotation axis of the cylinder when the left and right shells are connected to the frame 82. The cylinder 84 is located within the cavity 122 such that an upper gap 118 exists between the cylinder and the top 94 of the frame and a lower gap 120 exists between the cylinder and the bottom 96 of the frame. Furthermore, a gap 124 exists between the interior 216 of the right shell and the cylinder and a gap 126 exists between the interior 244 of the left shell and the cylinder. These gaps 118, 120, 124, and 126 enable the cylinder to rotate without obstruction or stoppage by either the frame or the left and right shells.

The forwardmost dimples 254 that removably attach the upper flange 246 of the left shell 204 to the upper flange 218 of the right shell are shown. To attach the upper flange 246 of the left shell to the upper flange 218 of the right shell, the upper horizontal flange 248 passes through the upper gap 118 between the cylinder 84 and the top 94 of the frame 82, and the dimple 254 is received by the dimple hole 226 in the top 206 of the right shell 202. The upper horizontal flange has two obtuse angles 256 and 258. These angles enable the dimples 254 to be axially aligned with the dimple holes 226. The top of the frame is thus clamped between the upper flanges 246 and 218 to releasably secure the left shell and right shell to the top of the frame. A sufficient portion of the upper gap remains between the upper horizontal flange and the cylinder to permit the cylinder to rotate without obstruction or stoppage by the upper horizontal flange.

The forwardmost dimples 254 that removably attach the lower flange 252 of the left shell 204 to the lower flange 224 of the right shell are shown. To attach the lower flange 252 of the left shell to the lower flange 224 of the right shell, the lower horizontal flange 250 passes through the lower gap 120 between the cylinder 84 and the bottom 96 of the frame 82, and the dimple 254 is received by the dimple hole 228 in the bottom 208 of the right shell 202. The lower horizontal flange has two obtuse angles 260 and 262. These angles enable the dimples 254 to be axially aligned with the dimple holes 228. The bottom of the frame is thus clamped between the lower flanges 252 and 224 to releasably secure the left shell and right shell to the bottom of the frame. A sufficient portion of the lower gap remains between the lower horizontal flange and the cylinder to permit the cylinder to rotate without obstruction or stoppage by the lower horizontal flange. The dimples 254 must be disengaged from the dimple holes 226, 228 and the left shell removed in order to permit the cylinder to swing outwards from the frame to the left to enable reloading.

Figure 5A:
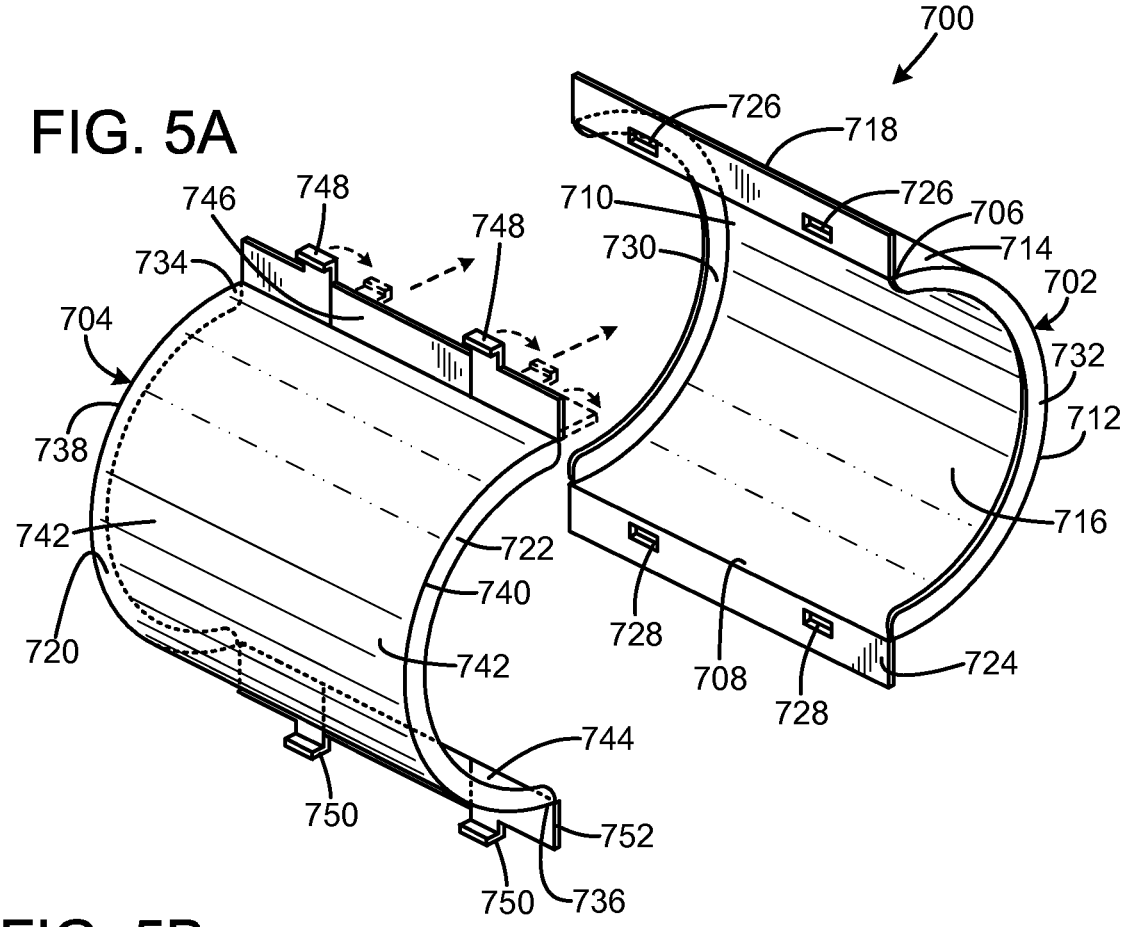
FIG. 5A is a rear isometric view of a second alternative embodiment of the cylinder shroud constructed in accordance with the principles of the present invention.

FIG. 5A illustrates a second alternative embodiment of the improved cylinder shroud 700 of the present invention. More particularly, the cylinder shroud has a left shell 704 and a right shell 702. The shells are substantially mirror images of one another in the current embodiment except for the tabs 748, 750 on the left shell and the slots 726, 728 on the right shell.

The left shell 704 is a semi-cylindrical body having a top 734, a bottom 736, a front 738, a rear 740, an exterior 742, and an interior 744. The front defines a front lip 720 that extends inwards. The rear defines a rear lip 722 that extends inwards. The lips are semicircular flanges with rounded concave edges that face one another. Each lip occupies a plane perpendicular to an axis defined by the semi-cylindrical body and depending toward the axis. The top of the left shell defines an upper flange 746. The upper flange extends perpendicularly upwards from the top of the left shell. Two tabs 748 extend upwards from the upper horizontal flange. In the current embodiment, the two tabs 748 are L-shaped and point outwards. The bottom of the left shell defines a lower flange 752. The lower flange extends perpendicularly downwards from the bottom of the left shell. Two tabs 750 extend upwards from the lower horizontal flange. In the current embodiment, the two tabs 750 are L-shaped and point outwards.

The right shell 702 is a semi-cylindrical body having a top 706, a bottom 708, a front 710, a rear 712, an exterior 714, and an interior 716. The front defines a front lip 730 that extends inwards. The rear defines a rear lip 732 that extends inwards. The lips are semicircular flanges with rounded concave edges that face one another. Each lip occupies a plane perpendicular to an axis defined by the semi-cylindrical body and depending toward the axis. The top of the right shell defines an upper flange 718. The upper flange extends perpendicularly upwards from the top of the right shell. The upper flange defines two slots 726 positioned to align with, and sized to receive, the two tabs 748 on the left shell 704. The bottom of the right shell defines a lower flange 724. The lower flange extends perpendicularly downwards from the bottom of the right shell. The lower flange defines two slots 728 positioned to align with, and sized to receive, the two tabs 750 on the left shell 704.

Figure 5B:
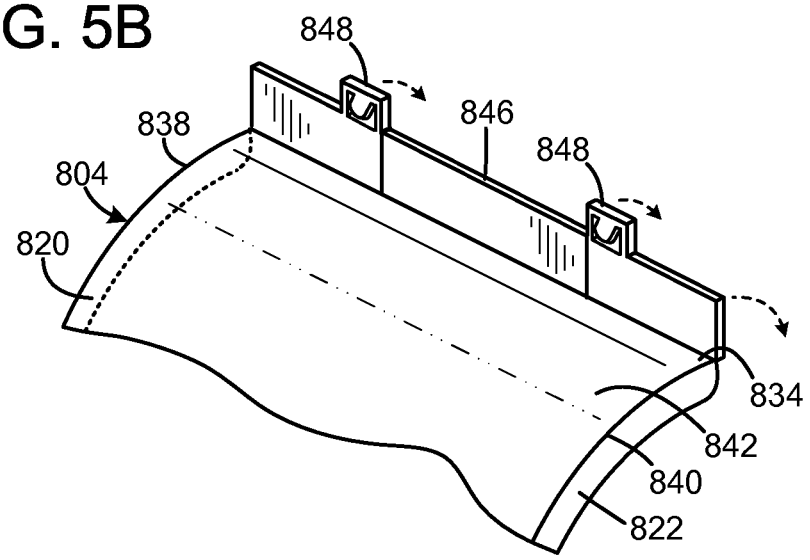
FIG. 5B is a rear isometric fragmentary view of a third embodiment of the left shell of the cylinder shroud constructed in accordance with the principles of the present invention.

FIG. 5B illustrates a third alternative embodiment of the left shell 804 of the present invention. More particularly, the left shell 804 is operable for use with the right shell 702 of FIG. 5A. The left shell 804 is substantially identical to the left shell 704 of FIG. 5A except for the replacement of the tabs 748, 750 with tabs 848. Only the top portion of the left shell 804 is shown.

The left shell 804 is a semi-cylindrical body having a top 834, a bottom (not shown), a front 838, a rear 840, an exterior 842, and an interior 844. The front defines a front lip 820 that extends inwards. The rear defines a rear lip 822 that extends inwards. The lips are semicircular flanges with rounded concave edges that face one another. Each lip occupies a plane perpendicular to an axis defined by the semi-cylindrical body and depending toward the axis. The top of the left shell defines an upper flange 846. The upper flange extends perpendicularly upwards from the top of the left shell. Two tabs 848 extend upwards from the upper flange. In the current embodiment, the two tabs 848 are three-part flanges with their tongues bent upward and are sized and positioned to be received by the two slots 726 on the right shell 702. The bottom of the left shell defines a lower flange (not shown). The lower flange extends perpendicularly downwards from the bottom of the left shell. Two tabs (not shown) extend downwards from the lower flange. In the current embodiment, the two tabs are three-part flanges with their tongues bent upward and are sized and positioned to be received by the two slots 720 on the right shell 702.

Figure 6A:
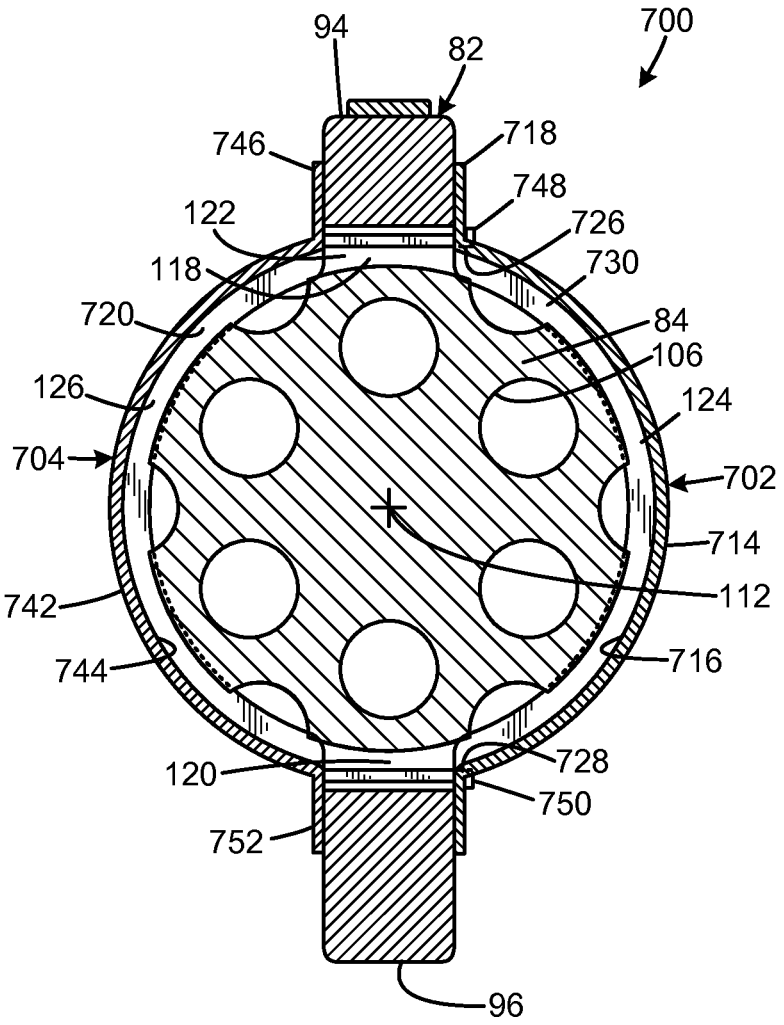
FIG. 6A is a cross-section view of a second alternative embodiment of the revolver with cylinder shroud with the cylinder shroud of FIG. 5A installed thereon.

FIG. 6A illustrates the improved cylinder shroud 700 of FIG. 5A installed on a revolver identical to the revolver depicted in FIG. 6. More particularly, the cylinder 84 has six chambers 106 and defines a rotation axis 112. The semi-cylindrical bodies of the left shell 704 and right shell 702 have a radius of curvature centered on the rotation axis of the cylinder when the left and right shells are connected to the frame 82. The cylinder 84 is located within the cavity 122 such that an upper gap 118 exists between the cylinder and the top 94 of the frame and a lower gap 120 exists between the cylinder and the bottom 96 of the frame. Furthermore, a gap 124 exists between the interior 716 of the right shell and the cylinder and a gap 126 exists between the interior 744 of the left shell and the cylinder. These gaps 118, 120, 124, and 126 enable the cylinder to rotate without obstruction or stoppage by either the frame or the left and right shells.

The forwardmost tab 748 that removably attaches the upper flange 746 of the left shell 704 to the upper flange 718 of the right shell is shown. To attach the upper flange 746 of the left shell to the upper flange 718 of the right shell, a portion of the upper flange 746 is bent inward horizontally and passed through the upper gap 118 between the cylinder 84 and the top 94 of the frame 82, and the tab 748 is received by the slot 726 in the upper flange 718. This releasably secures the left shell and right shell to the top of the frame. A sufficient portion of the upper gap remains between the upper flange and the cylinder to permit the cylinder to rotate without obstruction or stoppage by the upper flange.

The forwardmost tab 750 that removably attaches the lower flange 752 of the left shell 704 to the lower flange 724 of the right shell is shown. To attach the lower flange 752 of the left shell to the lower flange 724 of the right shell, a portion of the lower flange 752 is bent inward horizontally and passed through the lower gap 120 between the cylinder 84 and the bottom 96 of the frame 82, and the tab 750 is received by the slot 728 in the lower flange 724. This releasably secures the left shell and right shell to the bottom of the frame. A sufficient portion of the lower gap remains between the lower flange and the cylinder to permit the cylinder to rotate without obstruction or stoppage by the lower flange. The tabs 748, 750 must be disengaged from the slots 726, 728 and the left shell removed in order to permit the cylinder to swing outwards from the frame to the left to enable reloading.

Figure 7:
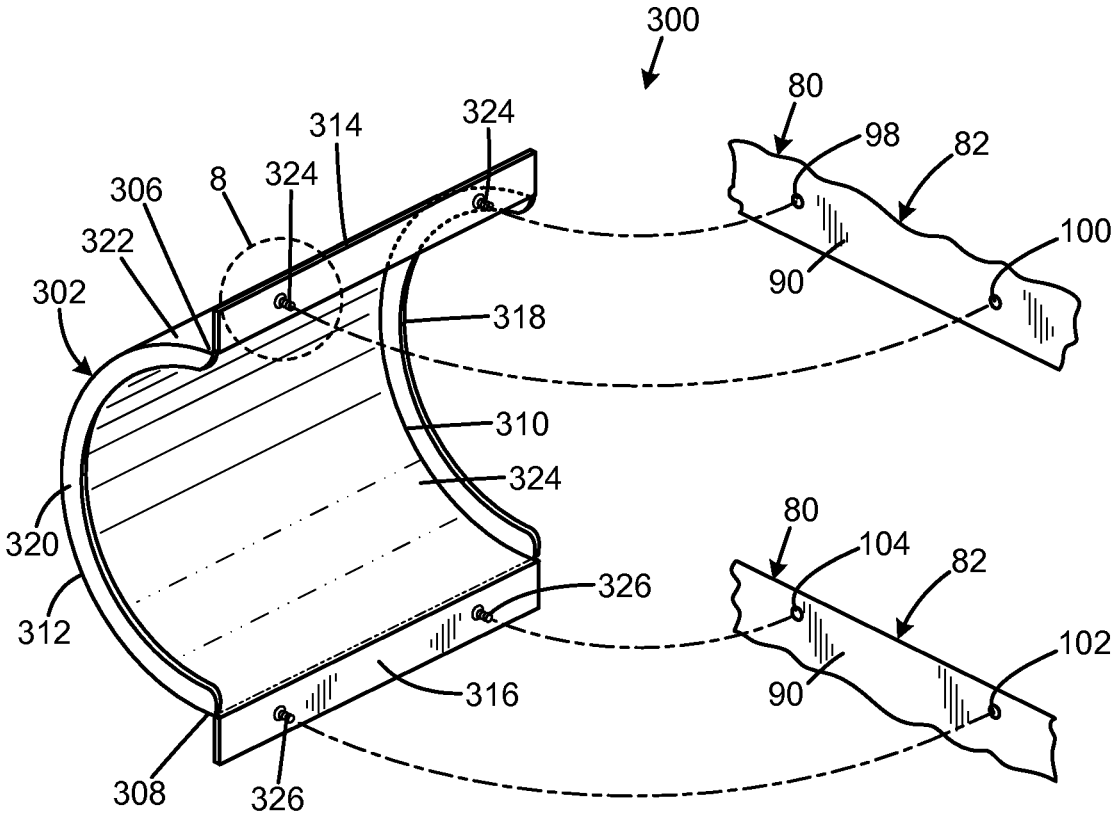
FIG. 7 is a rear isometric fragmentary view of a third alternative embodiment of the cylinder shroud constructed in accordance with the present invention.
Figure 8:
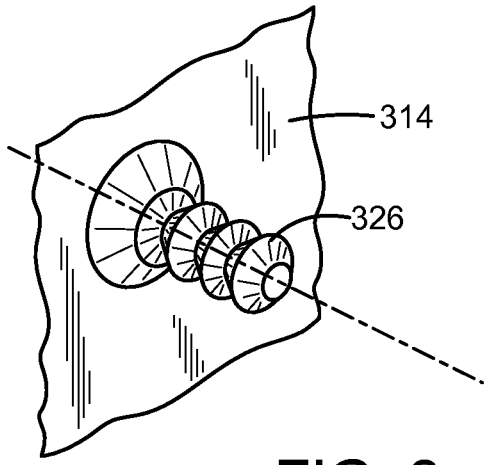
FIG. 8 is an enlarged view of the pop pin of FIG. 7.

FIGS. 7 and 8 illustrate a third alternative embodiment of the improved cylinder shroud 300 of the present invention. More particularly, the cylinder shroud has a left shell 302 and a right shell (not shown). The shells are substantially mirror images of one another in the current embodiment.

The left shell 302 is a semi-cylindrical body having a top 306, a bottom 308, a front 310, a rear 312, an exterior 322, and an interior 324. The front defines a front lip 318 that extends inwards. The rear defines a rear lip 320 that extends inwards. The lips are semicircular flanges with rounded concave edges that face one another. Each lip occupies a plane perpendicular to an axis defined by the semi-cylindrical body and depending toward the axis. The top of the left shell defines an upper flange 314. The upper flange extends perpendicularly upwards from the top of the left shell. Two pop pins 324 extend perpendicularly inwards from the upper flange. The bottom of the left shell defines a lower flange 316. The lower flange extends perpendicularly downwards from the bottom of the left shell. Two pop pins 326 extend perpendicularly inwards from the lower flange. In the current embodiment, which is shown in close-up in FIG. 8, the pop pins 324, 326 are composed of multiple stacked generally conical shapes.

A partial fragmentary view of the left side 90 of the frame 82 of a revolver 80 is shown. The left side of the frame of the revolver is drilled with bores 98, 100, 102, and 104. The left shell 302 is removably attached to the frame such that the left shell covers the portion of the cylinder that protrudes from the left side of the frame. This is accomplished by inserting pop pins 324, 326 into the bores in the left side of the frame. This releasably secures the left shell to the left side of the frame. The bores are aligned with the pop pins on the left shell when the left shell is positioned so the front 128 and rear 130 of the cylinder are enclosed between the front lip 318 and rear lip 320. The pop pins must be disengaged from the bores and the left shell removed in order to permit the cylinder to swing outwards from the frame to the left to enable reloading.

Figure 9:
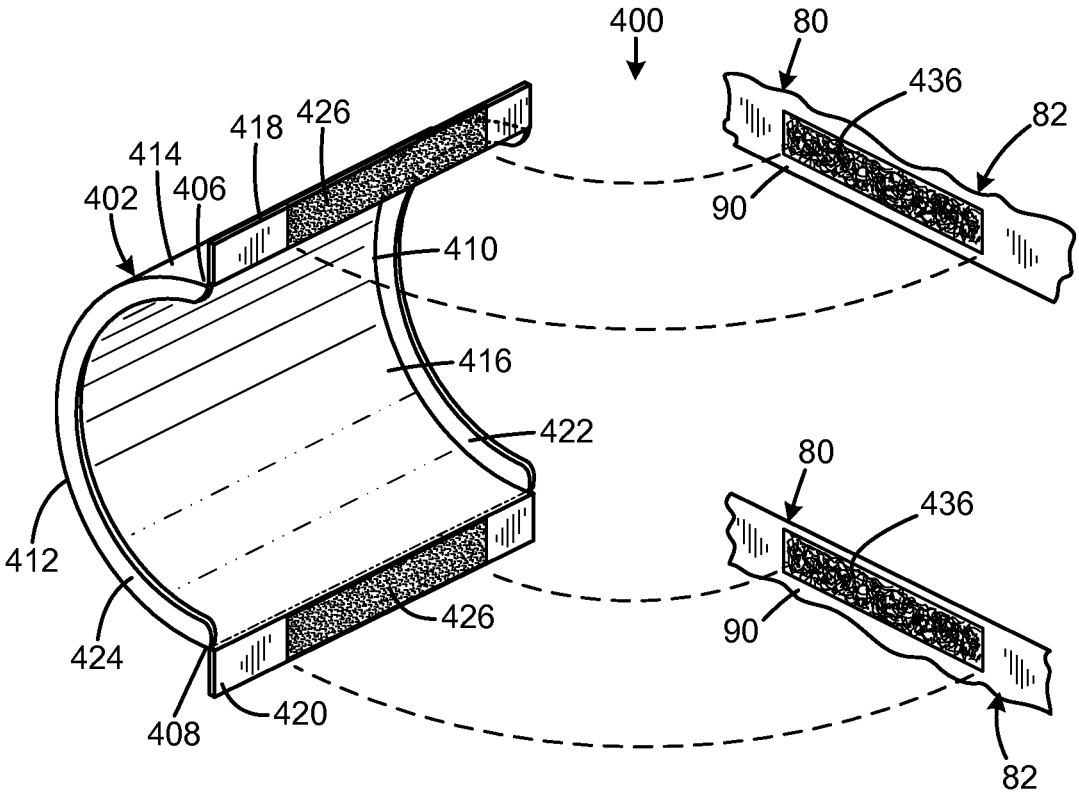
FIG. 9 is a rear isometric fragmentary view of a fourth alternative embodiment of the cylinder shroud constructed in accordance with the present invention.

FIG. 9 illustrates a fourth alternative embodiment of the improved cylinder shroud 400 of the present invention. More particularly, the cylinder shroud has a left shell 402 and a right shell (not shown). The shells are substantially mirror images of one another in the current embodiment.

The left shell 402 is a semi-cylindrical body having a top 406, a bottom 408, a front 410, a rear 412, an exterior 414, and an interior 416. The front defines a front lip 422 that extends inwards. The rear defines a rear lip 424 that extends inwards. The lips are semicircular flanges with rounded concave edges that face one another. Each lip occupies a plane perpendicular to an axis defined by the semi-cylindrical body and depending toward the axis. The top of the left shell defines an upper flange 418. The upper flange extends perpendicularly upwards from the top of the left shell. A strip of hook fastener 426 protrudes inward process from the interior of the upper flange. The bottom of the left shell defines a lower flange 420. The lower flange extends perpendicularly downwards from the bottom of the left shell. A strip of hook fastener 426 protrudes inwards from the interior of the lower flange.

A partial fragmentary view of the left side 90 of the frame 82 of a revolver 80 is shown. The left side of the frame of the revolver has loop fasteners 436. The left shell 302 is removably attached to the frame such that the left shell covers the portion of the cylinder that protrudes from the left side of the frame. This is accomplished by engaging the hook fastener 426 on the upper flange 418 in the hook fastener 426 on the lower flange 420 with the loop fasteners 436 on the left side of the frame. This releasably secures the left shell to the frame. The loop fasteners are aligned with the hook fasteners on the left shell when the left shell is positioned so the front 128 and rear 130 of the cylinder are enclosed between the front lip 422 and rear lip 424. The hook fasteners 426 must be disengaged from the loop fasteners 436 and the left shell removed in order to permit the cylinder to swing outwards from the frame to the left to enable reloading.

Figure 11:
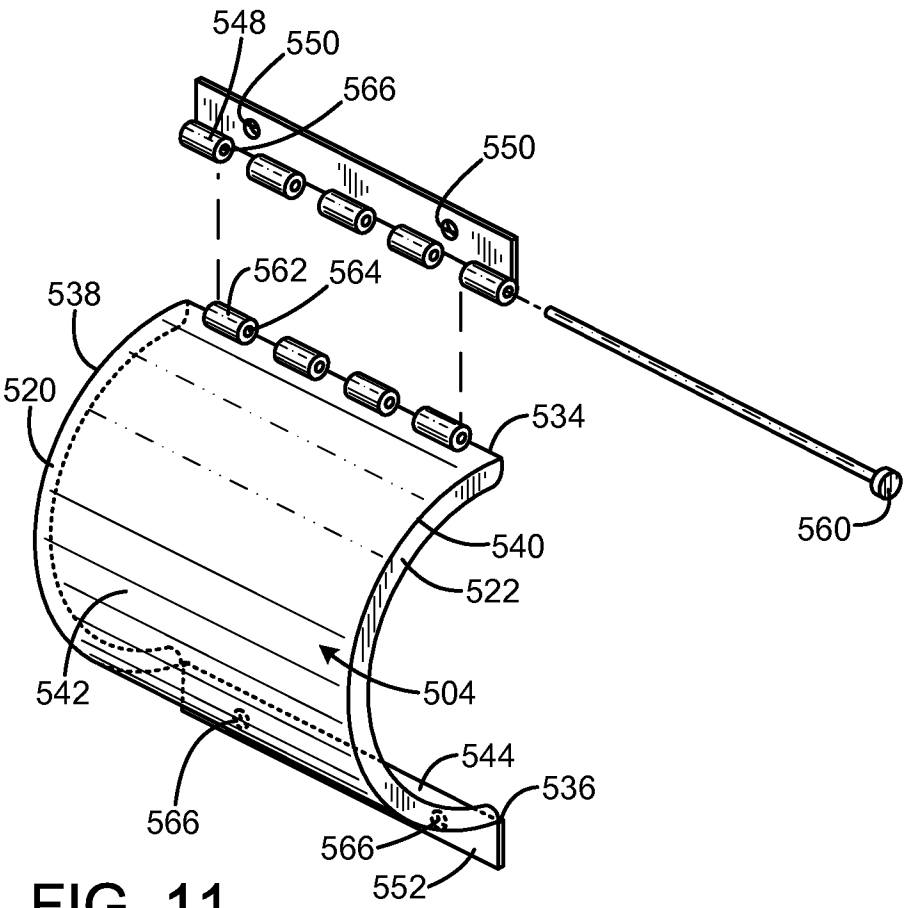
FIG. 11 is a rear isometric exploded view of the fifth alternative embodiment of the left shell of the cylinder shroud constructed in accordance with the present invention.
Figure 10:
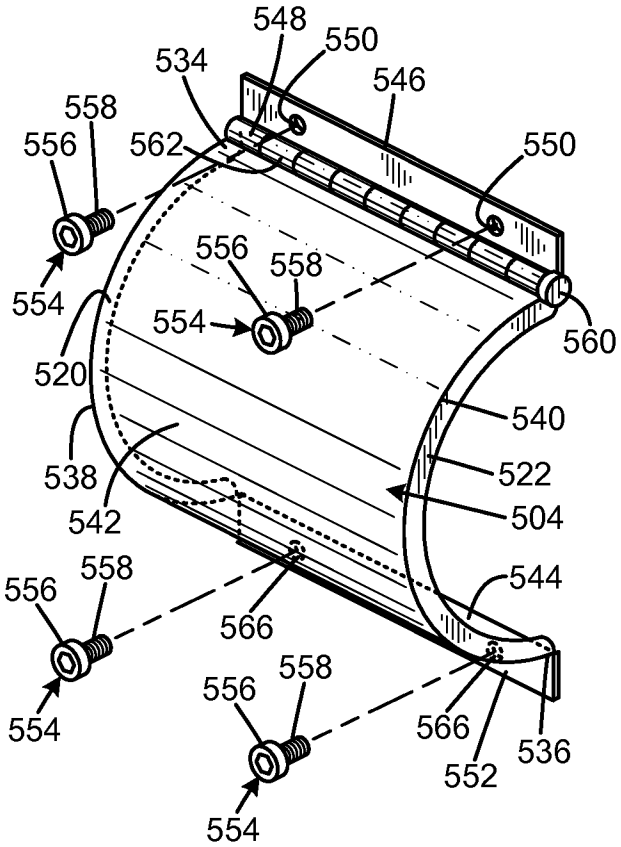
FIG. 10 is a rear isometric exploded view of a fifth alternative embodiment of the left shell of the cylinder shroud constructed in accordance with the present invention.

FIGS. 10 and 11 illustrate a fifth alternative embodiment of the left shell 504 of the present invention. More particularly, the left shell 504 is operable with the right shell 14 of FIGS. 1, 3, and 4 to form the complete cylinder shroud shown in FIG. 12. The shells are substantially mirror images of one another in the current embodiment except for the continuous hinge components on the left shell.

The left shell 504 is a semi-cylindrical body having a top 534, a bottom 536, a front 538, a rear 540, an exterior 542, and an interior 544. The front defines a front lip 520 that extends inwards. The rear defines a rear lip 522 that extends inwards. The lips are semicircular flanges with rounded concave edges that face one another. Each lip occupies a plane perpendicular to an axis defined by the semi-cylindrical body and depending toward the axis. The top of the left shell has a series of spaced knuckles 562 with central apertures 564. The top of the left shell also defines an upper flange 546. The upper flange extends perpendicularly upwards from the top of the left shell. The upper flange defines two bolt holes 550. The bolt holes 550 are sized to permit passage of the threaded portions 558 of bolts 554 and to obstruct passage of the head portions 556 of bolts 554. The upper flange also has a series of spaced knuckles 548 with central apertures 566. The knuckles 548, 562 are spaced to interleave with one another with their apertures 564, 566 coaxially aligned. A pin 560 is inserted through the apertures 564, 566 to form a continuous hinge. The bottom of the left shell defines a lower flange 552. The lower flange extends perpendicularly downwards from the bottom of the left shell. The lower flange defines two bolt holes 566. The bolt holes 566 are sized to permit passage of the threaded portions 558 of bolts 554 and to obstruct passage of the head portions 556 of bolts 554.

Figure 12:
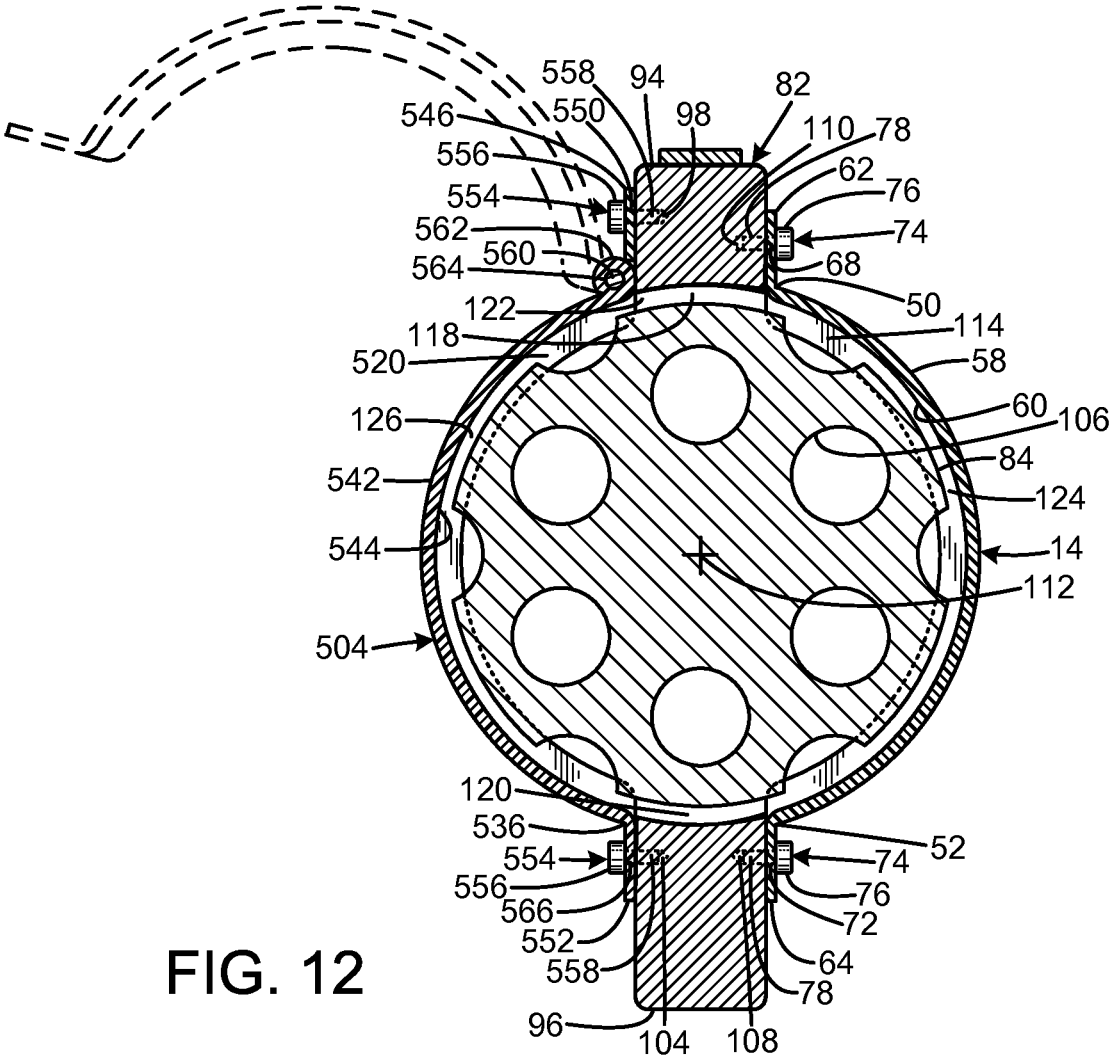
FIG. 12 is a cross-section view of the fifth alternative embodiment of the revolver with cylinder shroud with the cylinder shroud of FIGS. 10 and 11 installed thereon.

FIG. 12 illustrates an improved cylinder shroud composed of the left shell 504 of FIGS. 10 and 11 and the right shell 14 of FIGS. 1, 3, and 4 installed on a revolver identical to the revolver depicted in FIGS. 2-4 except for an upward change in location of the threaded bore holes 98 in the frame 82. More particularly, the cylinder 84 has six chambers 106 and defines a rotation axis 112. The semi-cylindrical bodies of the left shell 504 and right shell 14 have a radius of curvature centered on the rotation axis of the cylinder when the left and right shells are connected to the frame 82. The cylinder 84 is located within the cavity 122 such that an upper gap 118 exists between the cylinder and the top 94 of the frame and a lower gap 120 exists between the cylinder and the bottom 96 of the frame. Furthermore, a gap 124 exists between the interior 60 of the right shell and the cylinder and a gap 126 exists between the interior 544 of the left shell and the cylinder. These gaps 118, 120, 124, and 126 enable the cylinder to rotate without obstruction or stoppage by either the frame or the left and right shells.

The forwardmost bolts 554 that removably attach the upper flange 546 and lower flange 552 of the left shell 504 to the frame 82 are shown. To attach the front of the upper flange of the left shell, the threaded portion of 558 of a bolt 554 passes through the bolt hole 550 and is threadedly received by the threaded bore 98 in the frame. To attach the front of the lower flange of the left shell, the threaded portion 558 of a bolt 554 passes through the bolt hole 566 and is threadedly received by the threaded bore 104 in the frame. The bolts 554 that attach the lower flange of the left shell to the frame must be disengaged from the threaded bores in the frame and the left shell pivoted about the continuous hinge as depicted in order to permit the cylinder to swing outwards from the frame to the left to enable reloading.

The forwardmost bolts 74 that removably attach the upper flange 62 and the lower flange 64 of the right shell 14 to the frame 82 are also shown. To attach the front of the upper flange of the right shell, the threaded portion 78 of the bolt 74 passes through the bolt hole 68 and is threadedly received by the threaded bore 110 in the frame. To attach the front of the lower flange of the right shell, the threaded portion 48 of the bolt 44 passes through the bolt hole 72 and is threadedly received by the threaded bore 108 in the frame.

Figure 13:
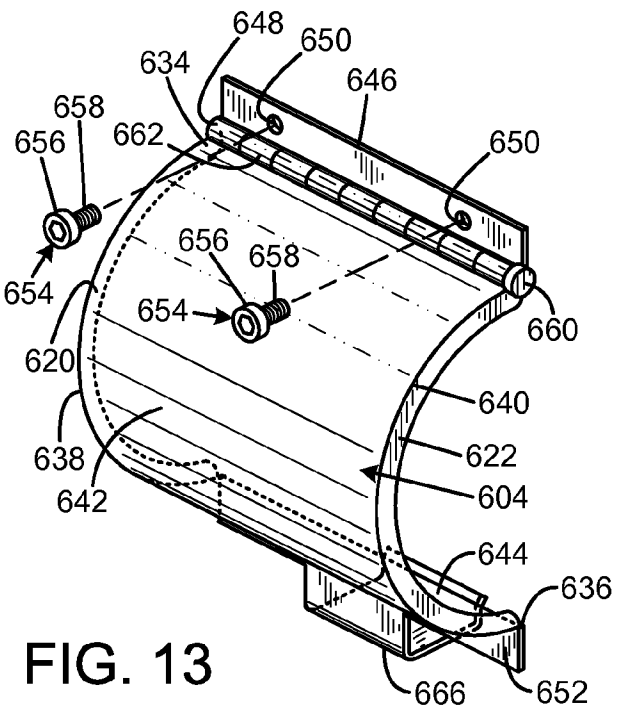
FIG. 13 is a rear isometric exploded view of a sixth alternative embodiment of the left shell of the cylinder shroud constructed in accordance with the present invention.

FIG. 13 illustrates a sixth alternative embodiment of the left shell 604 of the present invention. More particularly, the left shell 604 is operable with the right shell 14 of FIGS. 1, 3, and 4 to form the complete cylinder shroud shown in FIG. 14. The shells are substantially mirror images of one another in the current embodiment except for the continuous hinge components and spring hook 666 on the left shell.

The left shell 604 is a semi-cylindrical body having a top 634, a bottom 636, a front 638, a rear 640, an exterior 642, and an interior 644. The front defines a front lip 620 that extends inwards. The rear defines a rear lip 622 that extends inwards. The lips are semicircular flanges with rounded concave edges that face one another. Each lip occupies a plane perpendicular to an axis defined by the semi-cylindrical body and depending toward the axis. The top of the left shell has a series of spaced knuckles 662 with central apertures (not shown). The top of the left shell also defines an upper flange 646. The upper flange extends perpendicularly upwards from the top of the left shell. The upper flange defines two bolt holes 650. The bolt holes 650 are sized to permit passage of the threaded portions 658 of bolts 654 and to obstruct passage of the head portions 656 of bolts 654. The upper flange also has a series of spaced knuckles 648 with central apertures (not shown). The knuckles 648, 662 are spaced to interleave with one another with their apertures coaxially aligned. A pin 660 is inserted through the apertures to form a continuous hinge. The bottom of the right shell defines a lower flange 652. The lower flange extends perpendicularly downwards from the bottom of the left shell. The lower flange defines a spring hook 666. The spring hook extends inwards and is sized to snap over the bottom 96 of a revolver frame 82.

Figure 14:
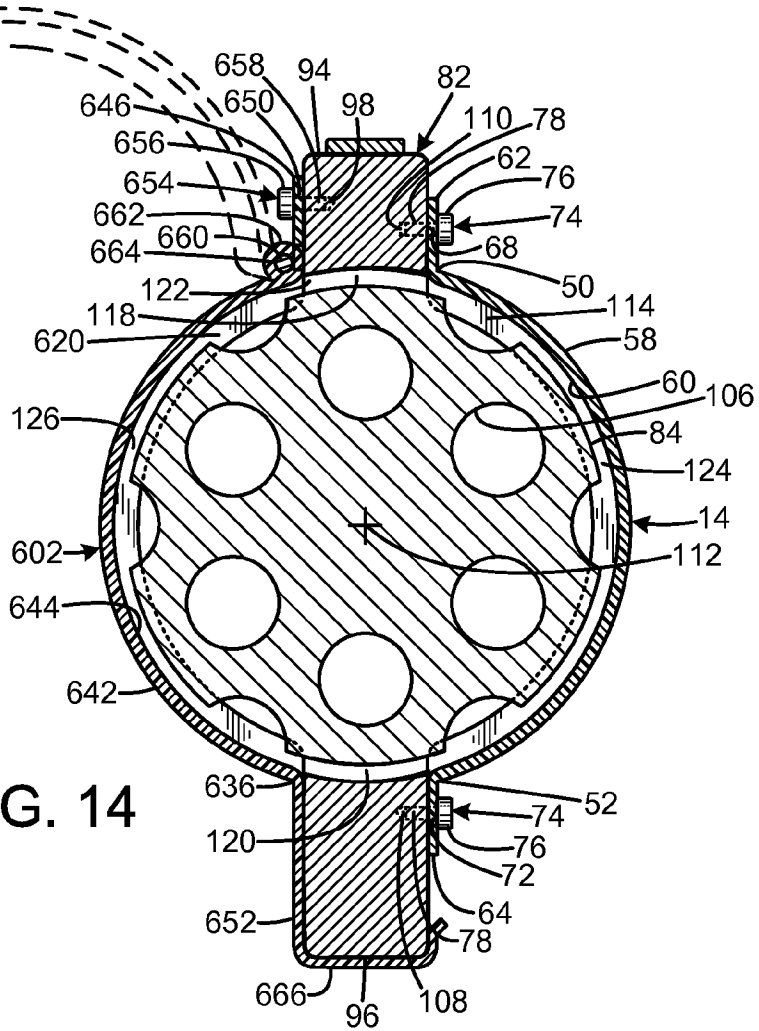
FIG. 14 is a cross-section view of the sixth alternative embodiment of the revolver with cylinder shroud with the cylinder shroud of FIG. 13 installed thereon.

FIG. 14 illustrates an improved cylinder shroud composed of the left shell 604 of FIG. 13 and the right shell 14 of FIGS. 1, 3, and 4 installed on a revolver identical to the revolver depicted in FIGS. 2-4 except for an upward change in location of the threaded bore holes 98, 100 in the top 94 of the frame 82 and elimination of the threaded bore holes 102, 104 in the bottom 96 of the frame. More particularly, the cylinder 84 has six chambers 106 and defines a rotation axis 112. The semi-cylindrical bodies of the left shell 604 and right shell 14 have a radius of curvature centered on the rotation axis of the cylinder when the left and right shells are connected to the frame 82. The cylinder 84 is located within the cavity 122 such that an upper gap 118 exists between the cylinder and the top 94 of the frame and a lower gap 120 exists between the cylinder and the bottom 96 of the frame. Furthermore, a gap 124 exists between the interior 60 of the right shell and the cylinder and a gap 126 exists between the interior 644 of the left shell and the cylinder. These gaps 118, 120, 124, and 126 enable the cylinder to rotate without obstruction or stoppage by either the frame or the left and right shells.

The forwardmost bolt 654 that removably attaches the upper flange 546 of the left shell 504 to the frame 82 is shown. To attach the front of the upper flange of the left shell, the threaded portion 658 of a bolt 654 passes through the bolt hole 650 and is threadedly received by the threaded bore 98 in the frame. To attach the lower flange 652 of the left shell to the bottom 96 of the frame, the spring hook 666 is pulled downwards and snapped inwards over the bottom of the frame. The spring hook 666 must be disengaged from the bottom of the frame and the left shell pivoted about the continuous hinge as depicted in order to permit the cylinder to swing outwards from the frame to the left to enable reloading.

The forwardmost bolts 74 that removably attach the upper flange 62 and the lower flange 64 of the right shell 14 to the frame 82 are also shown. To attach the front of the upper flange of the right shell, the threaded portion 78 of the bolt 74 passes through the bolt hole 68 and is threadedly received by the threaded bore 110 in the frame. To attach the front of the lower flange of the right shell, the threaded portion 48 of the bolt 44 passes through the bolt hole 72 and is threadedly received by the threaded bore 108 in the frame.

Figure 15:
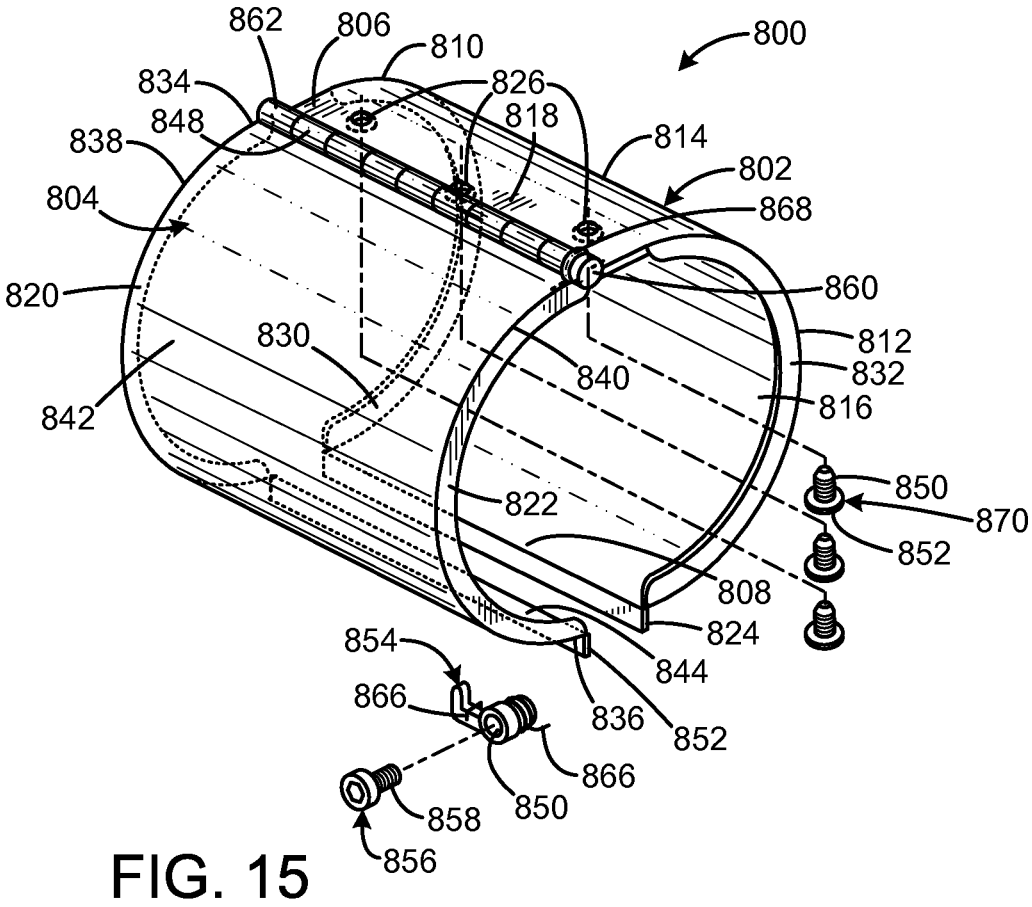
FIG. 15 is a rear isometric exploded view of a seventh alternative embodiment of the cylinder shroud constructed in accordance with the principles of the present invention.

FIG. 15 illustrates a seventh alternative embodiment of the cylinder shroud 800 of the present invention. More particularly, a left shell 804 is joined to a right shell 802 by continuous hinge components to form a complete cylinder shroud 800. The shells are substantially mirror images of one another in the current embodiment except for the continuous hinge components.

The left shell 804 is a semi-cylindrical body having a top 834, a bottom 836, a front 838, a rear 840, an exterior 842, and an interior 844. The front defines a front lip 820 that extends inwards. The rear defines a rear lip 822 that extends inwards. The lips are semicircular flanges with rounded concave edges that face one another. Each lip occupies a plane perpendicular to an axis defined by the semi-cylindrical body and depending toward the axis. The top of the left shell has a series of spaced knuckles 862 with central apertures (not visible). The bottom of the left shell defines a lower flange 852. The lower flange extends perpendicularly downwards from the bottom of the left shell.

The right shell 802 is a semi-cylindrical body having a top 806, a bottom 808, a front 810, a rear 812, an exterior 814, and an interior 816. The front defines a front lip 830 that extends inwards. The rear defines a rear lip 832 that extends inwards. The lips are semicircular flanges with rounded concave edges that face one another. Each lip occupies a plane perpendicular to an axis defined by the semi-cylindrical body and depending toward the axis. The top of the right shell defines an upper flange 818. The upper flange extends horizontally outwards from the top of the right shell. The upper flange defines three offset tapered screw holes 826. The screw holes 826 are sized to permit passage of the threaded portions 850 of screws 848 and to obstruct passage of the head portions 852 of screws 870. The screws 870 have tapered heads that match the tapered screw holes, so the screws 870 are "countersunk" to achieve a flush result. The bottom of the right shell defines a lower flange 824. The lower flange extends perpendicularly downwards from the bottom of the right shell.

The upper flange also has a series of spaced knuckles 848 with central apertures (not visible). The knuckles 848, 862 are spaced to interleave with one another with their apertures coaxially aligned. A pin 860 is inserted through the apertures to form a continuous hinge. An axial spring 868 is mounted on the pin to bias the left shell 804 towards a raised position.

Figure 16:
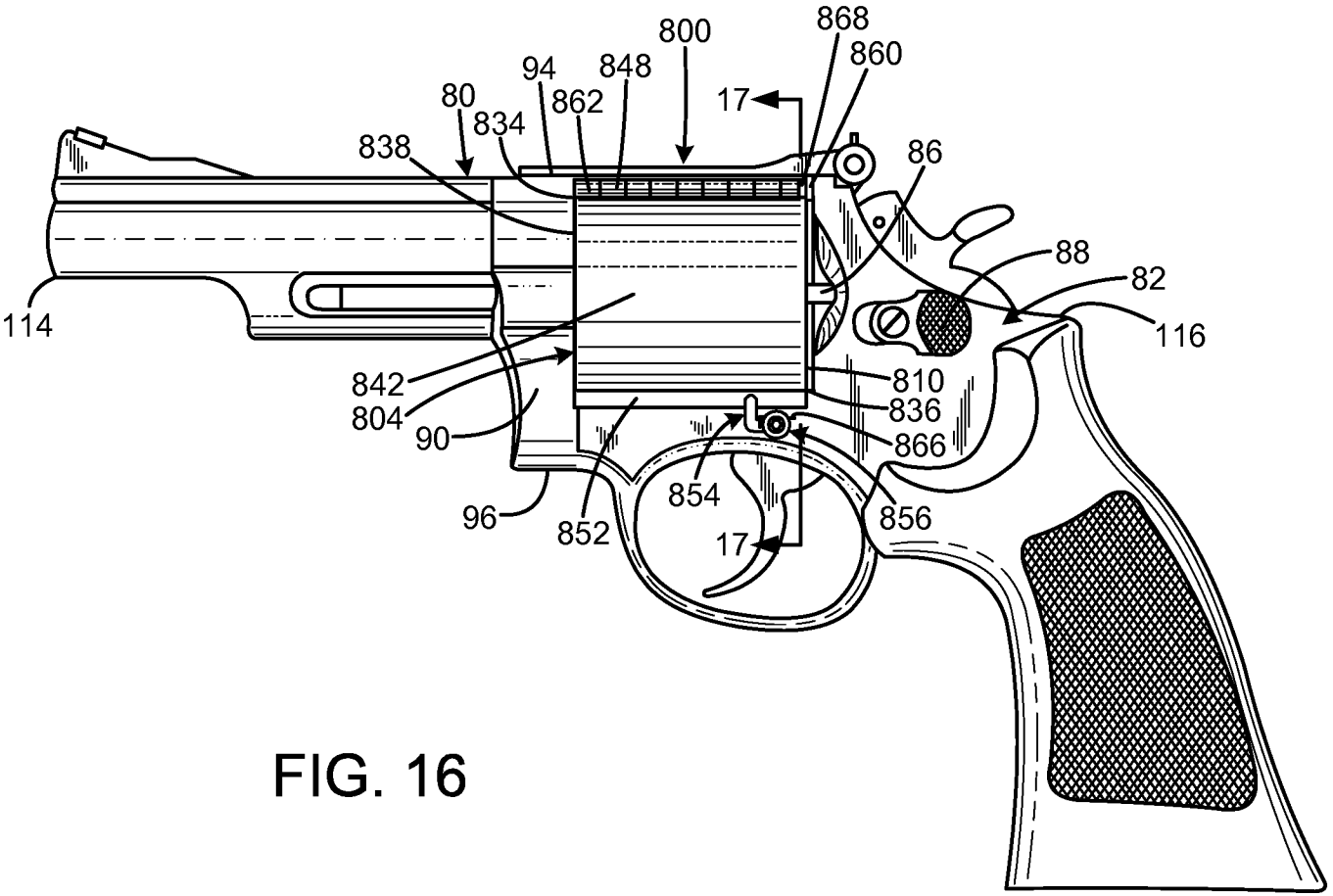
FIG. 16 is a left side view of the seventh alternative embodiment of the revolver with cylinder shroud with the cylinder shroud of FIG. 15 installed.
Figure 17:
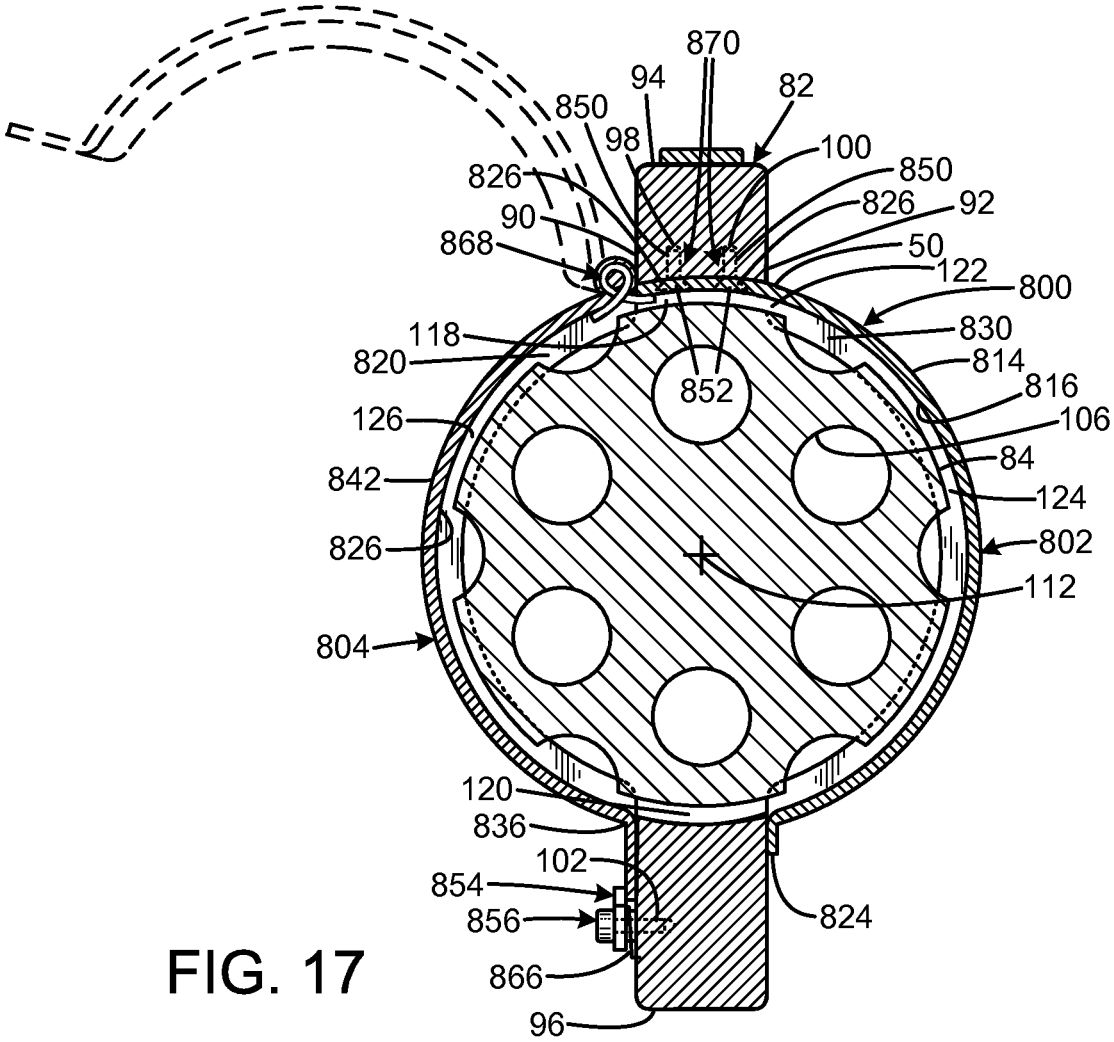
FIG. 17 is a cross-section view taken along the line 17-17 of FIG. 16.

FIGS. 16-17 illustrate the seventh alternative embodiment of the cylinder shroud 800 installed on a revolver 80 that is adapted to receive the left and right shells of FIG. 15. More particularly, the revolver has a frame 82 having a left side 90, a right side 92 (shown in FIG. 17), a top 94, a bottom 96, a front 114, and a rear 116. A cylinder 84 is rotatably mounted on a center pin 86 within a cavity 122 defined by the frame. A thumbpiece 88 protrudes from the rear 116 of the frame behind the cavity. The thumbpiece is operable to release the rearmost portion of the center pin from the cavity, which permits the cylinder to swing outwards from the frame to the left to enable reloading.

The cylinder 84 has six chambers 106 and defines a rotation axis 112. The semi-cylindrical bodies of the left shell 804 and right shell 802 have a radius of curvature centered on the rotation axis of the cylinder when the left and right shells are connected to the frame 82. The cylinder 84 is located within the cavity 122 such that an upper gap 118 exists between the cylinder and the top 94 of the frame and a lower gap 120 exists between the cylinder and the bottom 96 of the frame. Furthermore, a gap 124 exists between the interior 816 of the right shell and the cylinder and a gap 126 exists between the interior 826 of the left shell and the cylinder. These gaps 118, 120, 124, and 126 enable the cylinder to rotate without obstruction or stoppage by either the frame or the left and right shells.

The top underside of the frame 82 of the revolver is drilled and tapped with threaded bores (98, 100 are shown) that are in communication with the cavity 122. The bottom of the frame of the revolver is drilled and tapped with a threaded bore 102 below the cavity. The right shell 802 is removably attached to the frame such that the right shell covers the portion of the cylinder 84 that protrudes from the right side of the frame. This is accomplished by screwing screws 870 through the screw holes 826 in the upper flange 818 into the threaded bores in the top underside of the frame. The threaded bores are aligned with the screw holes 826 in the right shell when the right shell is positioned so the front 128 and rear 130 of the cylinder are enclosed between the front lip 830 and rear lip 832.

A latch tab 854 that removably attaches the lower flange 852 of the left shell 804 to the frame 82 is shown. To attach the rear of the lower flange of the left shell, the threaded portion of 858 of a bolt 856 passes through a bolt hole 850 in the latch tab and is threadedly received by a threaded bore 102 in the frame. The latch tab includes a spring 866 that is anchored in the frame. The spring biases the latch tab such that the latch tab covers a portion of the lower flange of the left shell and prevents the left shell from lifting upwards. The latch tab must be disengaged from the lower flange of the left shell and the left shell pivoted about the continuous hinge into a raised position under the influence of the axial spring 868 as depicted in FIG. 17 in order to permit the cylinder to swing outwards from the frame to the left to enable reloading.

While current embodiments of the revolver with cylinder shroud have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cylinder shroud for a revolver having a frame with a rotatable cylinder protruding from the frame and having a length and a cylindrical exterior surface, the shroud comprising:

first and second shroud portions, each having a cylindrical wall portion having a length at least as great as the length of the cylinder;

the first and second shroud portions each having an interior surface shaped to be closely spaced apart from an exterior surface portion of the cylinder;

the first and second shroud portions each including a fastening mechanism operable to removably connect the first shroud to the frame; and the first and second shroud portions each including a fastening element operable to removably connect the first and second shroud portions to the frame to cover the cylinder.

2. The cylinder shroud of claim 1 wherein each of the first and second shroud portions have a major cylindrical wall portion having a radius of curvature centered on an axis defined by the cylinder when the first and second shroud portions are connected to the frame.

3. The cylinder shroud of claim 1 wherein each of the first and second shroud portions have a major cylindrical wall portion having a curved forward edge and a curved rear edge, and having a lip at the forward and a lip at the rear edge, each lip occupying a plane perpendicular to an axis defined by the cylindrical wall portion, and depending toward the axis.

4. The cylinder shroud of claim 3 wherein the lips have surfaces facing each other, and spaced apart by a length greater than a length of the cylinder.

5. The cylinder shroud of claim 1 wherein the revolver has a planar frame portion surrounding the cylinder and having opposed major faces, and wherein the shroud portions protrude from the major faces when connected to the frame.

6. The cylinder shroud of claim 1 wherein at least one of the shroud portions connect directly to the frame.

7. The cylinder shroud of claim 1 wherein the shroud portions connect directly to each other.

8. The cylinder shroud of claim 1 wherein the revolver has an upper gap between the cylinder and an upper portion of the frame, and a lower gap between the cylinder and a lower portion of the frame, and wherein fastening element of at least one of the shroud portions extends through at least one of the upper and lower gaps when the shroud portions are connected to the frame.

9. The cylinder shroud of claim 1 wherein at least one of the shroud portions is hingedly connected to the frame.

10. A revolver comprising:

a frame;

a rotatable cylinder connected to the frame;

the cylinder having a length and a cylindrical exterior surface;

a shroud removably connectable to the frame and comprising:

first and second shroud portions, each having a cylindrical wall portion having a length at least as great as the length of the cylinder;

the first and second shroud portions each having an interior surface shaped to be closely spaced apart from an exterior surface portion of the cylinder;

the first and second shroud portions each including a fastening mechanism operable to removably connect the first shroud to the frame; and the first and second shroud portions each including a fastening element operable to removably connect the first and second shroud portions to the frame to cover the cylinder.

11. The revolver of claim 10 wherein each of the first and second shroud portions have a major cylindrical wall portion having radius of curvature centered on an axis defined by the cylinder when the first and second shroud portions are connected to the frame.

12. The revolver of claim 10 wherein each of the first and second shroud portions have a major cylindrical wall portion having a curved forward edge and a curved rear edge, and having a lip at the forward and a lip at the rear edge, each lip occupying a plane perpendicular to an axis defined by the cylindrical wall portion, and depending toward the axis.

13. The revolver of claim 12 wherein the lips have surfaces facing each other, and spaced apart by a length greater than a length of the cylinder.

14. The revolver of claim 10 having a planar frame portion surrounding the cylinder and having opposed major faces, and wherein the shroud portions protrude from the major faces when connected to the frame.

15. The revolver of claim 10 wherein at least one of the shroud portions connect directly to the frame.

16. The revolver of claim 10 wherein the shroud portions connect directly to each other.

17. The revolver of claim 10 having an upper gap between the cylinder and an upper portion of the frame, and a lower gap between the cylinder and a lower portion of the frame, and wherein fastening element of at least one of the shroud portions extends through at least one of the upper and lower gaps when the shroud portions are connected to the frame.

18. The revolver of claim 10 wherein at least one of the shroud portions is hingedly connected to the frame.

* * * * *